US006588873B1

(12) United States Patent
Walsh et al.

(10) Patent No.: US 6,588,873 B1
(45) Date of Patent: Jul. 8, 2003

(54) PRINTING APPARATUS AND METHOD

(75) Inventors: Simon Walsh, Leixlip (IE); Ah Chong Tee, Singapore (SG); Bee Bee Ang, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/136,741

(22) Filed: Apr. 29, 2002

(51) Int. Cl.[7] ..... B41J 2/015

(52) U.S. Cl. ..... 347/23

(58) Field of Search ..... 347/23, 14, 19, 347/22, 29, 30, 32, 33, 35

(56) References Cited

U.S. PATENT DOCUMENTS

| | | | | |
|---|---|---|---|---|
| 4,683,481 | A | 7/1987 | Johnson | 347/65 |
| 5,278,584 | A | 1/1994 | Keefe et al. | 347/63 |
| 6,203,135 | B1 | 3/2001 | Murcia et al. | 347/22 |
| 6,270,183 | B1 | 8/2001 | Gaarder | 347/29 |

*Primary Examiner*—Shih-Wen Hsieh

(57) ABSTRACT

An inkjet printing device comprising first and second pens and first and second service stations, the first and second service stations being arranged in a split servicing configuration and being arranged to service the first and second pens respectively, the device being adapted to detect the failure of a said pen and to print in a reserve mode in response to the detection, the device being further adapted to implement a modified servicing routine during reserve mode printing, the modified servicing routine being adapted to omit servicing of the failed pen.

22 Claims, 2 Drawing Sheets

PRINTING APPARATUS AND METHOD

FIELD OF THE INVENTION

The present invention relates generally to hardcopy devices, particularly but not exclusively to inkjet printers and to a method of servicing such devices.

BACKGROUND TO THE INVENTION

As is well known in the art, conventional inkjet printers generally employ one or more inkjet cartridges, often called "pens", which eject drops of ink onto a page or sheet of print media. For instance, two earlier thermal ink ejection mechanisms are shown in U.S. Pat. Nos. 5,278,584 and 4,683,481, both assigned to Hewlett-Packard Company. The pens are usually mounted on a carriage, which is arranged to scan across a scan axis relative to a sheet of print media as the pens print a series of individual drops of ink on the print media. The series of drops collectively form a band or "swath" of an image, such as a picture, chart or text. Between scans, the print medium is advanced relative to the scan axis. In this manner, an image may be incrementally printed.

In order to ensure satisfactory print quality, a "service station" apparatus is typically located within the printer chassis, laterally offset to one side of the printzone, so that the printheads can be periodically moved to a servicing position and serviced. Such service stations usually include a number of elastomeric wipers, used to wipe the printhead surface with an ink solvent, such as a polyethylene glycol ("PEG") compound, to remove any ink residue, paper dust, or other matter that has collected on the face of the printhead. Additionally, service stations usually include one or more reservoirs, termed "spittoons" which are designed to receive and store drops of ink ejected during "spitting" operations. "Spitting" is the term given to the process by which a number of ink drops are fired through one or more nozzles of a printhead in order to remove a blockage in the nozzle caused by dried ink or other matter. Service stations may also include a capping system that seals and protects the printhead nozzles from contaminants and drying out during non-printing periods. One example of a servicing station for an inkjet device is disclosed in U.S. Pat. No. 6,203,135 entitled "Independent Servicing Of Multiple Inkjet Printheads", in the name of Hewlett-Packard Co.

Between printing consecutive passes over the print zone, the carriage must reverse direction. This entails decelerating from the printing speed of the printer to zero and reaccelerating back to the printing speed in the reverse direction. This process is generally carried out outside the print zone in order to allow the printing process to be carried out at a constant printing speed. Consequentially, the scan axis must extend on either side of the print zone by a distance that is at least equal to this "turn around" distance. In practice, the size of inkjet service stations means that they generally extend from the edge of the print zone by a distance that is even greater than the "turn around" distance. Consequently, the size of service stations often contributes directly to the footprint of the printer.

Printers with "split" service stations address this problem by locating a reduced width service station within the "turn around" distance at either side of the print zone. Different pens are then serviced at different sides of the print zone. By using this service station configuration, the degree to which the size of service station contributes to the footprint of the printer may be significantly reduced, or eliminated. Thus, the footprint of the printer may be correspondingly reduced. One example of an inkjet printer device with a reduced footprint is disclosed in U.S. Pat. No. 6,270,183, assigned to Hewlett-Packard Company.

Over recent years the importance placed on the throughput of inkjet printers has risen dramatically. Throughput is generally measured as the number of pages of a given size, or the area of print media that a printer may ink in a given time. One factor that has a negative impact on the throughput of an inkjet printer is the time required to service the printheads.

It would therefore be desirable to provide an inkjet apparatus and method for servicing such devices, which addresses this issue.

SUMMARY OF THE INVENTION

According to one aspect of the present invention there is provided an inkjet printing device comprising a print zone and first and second printheads mounted to a carriage arranged to traverse said print zone, said device further comprising first and second service stations arranged to service said first and second printheads respectively, said service stations being located such that said carriage has first and second servicing positions to allow the servicing of said first and second pens respectively, said device being arranged to print in a first print mode in which said first printhead is not used and being further arranged not to service said first printhead whilst printing in said first print mode.

In a printer device that has split service stations and is adapted to print in a reserve mode when a pen fails, a significant amount of time may be saved in servicing routines by deselecting the failed pen from servicing. This is because split servicing is, generally speaking, a series process. This means that one pen, which is serviced at a first side of the printzone, is serviced first and subsequently another pen is serviced at a second side of the print zone. This is in contrast to conventional, non-split servicing printers, where all pens may be simultaneously serviced. Thus, whereas there is no extra time overhead associated with servicing a failed pen in convention, non-split servicing printers, this is not the case in split serviced printers.

Thus, by avoiding servicing a failed pen in a split service printer, time savings come from two main sources: firstly, from the time that is saved by not having to move the failed pen across the print zone to its service station; and, secondly, from the time that is saved by not implementing the actual servicing routine with regard to the failed pen, for example a splitting routine. Advantageously, the time saved in such servicing routines may result in a direct increase in the throughput of the printer.

A further advantage of the present invention is that it may reduce the amount of airborne ink droplets, termed aerosol, which are generated by spitting operations. Even though a pen, printer cartridge or printhead may be deemed to have failed, and thus not be used for printing, it may still be able to spit ink from some nozzles during spitting routines. Such aerosol droplets can cause many problems in printers. For example, airborne droplets may stain any areas with which they come into contact. Thus, the may reduce the effectiveness of optical devices and sensors used in the printer. Additionally, however, aerosol ink of one colour may contaminate the ink supply or servicing modules of another ink colour. This may lead to a visible deterioration in the quality of the printed output of the printer.

The present invention also extends to the corresponding method. Furthermore, the present invention also extends to a computer program, arranged to implement the method of the present invention.

BRIEF DESCRIPTION OF THE DRAWINGS

For a better understanding of the invention and to show how the same may be carried into effect, there will now be described by way of example only, specific embodiments, methods and processes according to the present invention with reference to the accompanying drawings in which.

DETAILED DESCRIPTION OF THE BEST MODE FOR CARRYING OUT THE INVENTION

There will now be described examples of the best mode contemplated by the inventors for carrying out the invention.

First Embodiment

The present embodiment will now be described with reference to a split service station type inkjet printer with a reduced footprint. Commonly assigned U.S. Pat. No. 6,270,183 describes an exemplary system with a split service station configuration and a reduced footprint that can employ aspects of the present invention. The entire contents of U.S. Pat. No. 6,270,183 are incorporated herein by reference.

Figure 1:
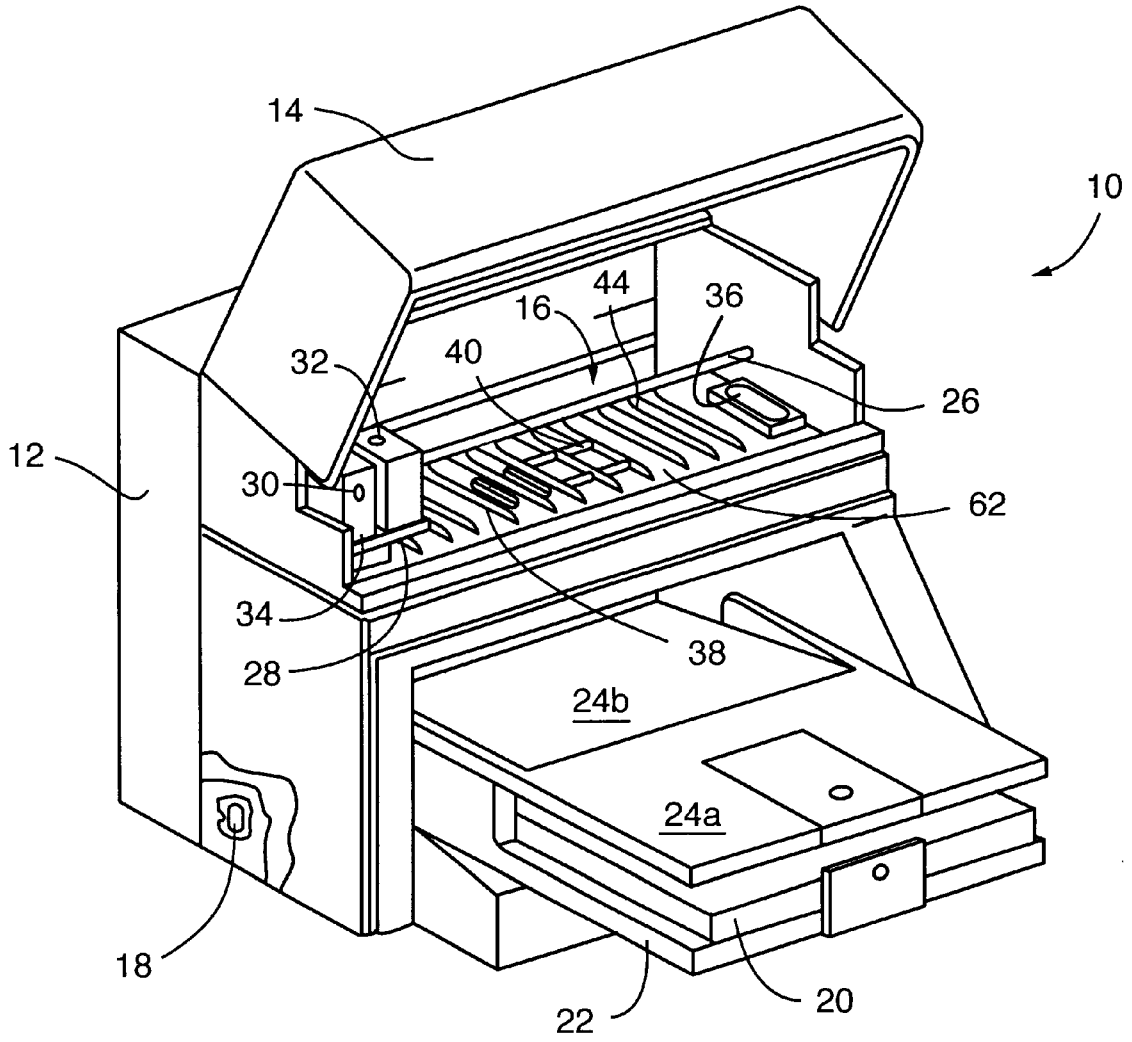
FIG. 1 is a perspective view of a split service inkjet device arranged to implement the method of one embodiment of the present invention; and, FIG. 2 is a flow diagram illustrating the method of one embodiment of the present invention.

The present embodiment of the invention will now be described. Referring to FIG. 1, a perspective view of an inkjet printer 10, which is arranged to implement the method of the present embodiment, is shown. In this example, the printer 10 is of the type designed to be supported on a surface such as a desk top. The printer has a housing or casing 12, typically manufactured from a plastics material. The casing has a lid 14, which is illustrated in the open position exposing the print zone 16 of the printer.

The printer has a printer controller, illustrated schematically as a microprocessor 18, that receives instructions from a host device, which is typically a computer, such as a personal computer or a computer aided drafting (CAD) computer system (not shown). The controller 18 has associated memory (not shown), which includes ROM and RAM. Image data, which is downloaded from a host device, may be stored in the RAM prior to being printed. The ROM stores operating instructions, which the controller 18 accesses in order to carry out the functions of the printer.

When a printing operation is initiated, a sheet of print media is picked from a stack of paper 20, or other print media such as transparencies and the like, held in an input tray 22. The sheet is fed into the printer using a conventional sheet feeding mechanism. The sheet is then brought around in a U direction to travel in the opposite direction towards an output tray 24*a*. The sheet is then stopped in the print zone 16 in order to allow a printing operation to be performed.

The printer has a slider rod 26 mounted to the body of the printer that defines a scan axis. A scanning carriage 28, supporting two cartridges 30 and 32, is slideably mounted to the slider rod, allowing the carriage to travel back and forth, reciprocally, across the print zone 16. In the present example, cartridge 30 is arranged to store and print black ink and cartridge 32 is a tri-colour cartridge, arranged to store and print each of cyan, magenta and yellow ink. In the present embodiment, the cartridges 30 and 32 may be conventional inkjet cartridges employing conventional thermal inkjet printheads, although in other embodiments other types of printheads, such as piezoelectric printheads, may be used.

A conventional carriage drive motor (not shown), such as a stepper motor, is used to propel the carriage across the print zone in response to control signals output by the controller. The controller also outputs firing signals, via a trailer cable (not shown), to the print cartridges in a conventional manner. The firing signals cause the nozzles of the printheads of the respective cartridges to selectively fire at the appropriate times to deposit ink at the desired locations of the print medium.

After a single or multiple printing passes by the carriage across the print zone, the sheet is incrementally advanced through the print zone by the sheet feeding mechanism. Again this occurs in response to signals output by the controller. In this manner, further swaths of image content may be printed, building up a completed image. When the printing on the sheet is complete, the sheet is forwarded to an output position 24*b* in output tray 24*a*.

Also shown in the figure are the service station components of the printer 10. In the present embodiment, two spittoons 34 and 36 are utilized. Spittoon 34 is used to receive ink ejected by cartridge 30 and spittoon 36 is used to receive ink ejected by cartridge 32. In the figure, the cartridge 30 is shown positioned above the spittoon 34, in its spitting position. As can be seen from the figure, the spittoons are arranged in a split configuration. Thus, the spittoons are disposed outside of, and on opposite sides of the print zone. The skilled reader will realise that by locating the spittoons outside of the print zone, it is possible for the spittoons to be used whilst a sheet of print media is located in the print zone. Thus, spitting operations may be implemented whilst a given sheet of print media is being printed.

Also shown in the figure are two wipers 38 and two caps 40. In the present embodiment, one wiper and one cap are arranged to service one of the printheads exclusively and the remaining wiper and cap are arranged to service the other printhead exclusively. In the present embodiment, the wipers and caps are located within the print zone, protruding through holes (not shown) in the platen 42. Also shown in the figure are a series of ribs 44 forming part of the platen that extend in the media feed direction across the width of the platen. The ribs support the media sheets from below as they pass through the print zone and ensure that the sheets of print media pass a sufficient distance above the wipers and caps that no residual ink from the wipers and caps contaminates the underside of the print medium. When in their operative state, the wipers and caps are raised up relative to the platen to a height sufficient to allow wiping and capping of the cartridges to take place. This may be achieved using a conventional camming mechanism (not shown).

In the present embodiment, the wipers and caps may be located inside the print zone, since in the present embodiment the wiping and capping functions are only required during periods of non-use; i.e. when there is no print media in the print zone. However, the skilled reader will appreciate that in other embodiments of the invention, the wipers and/or caps may instead be located outside of the print zone. This may be in a split configuration. For example, the wipers of the different cartridges may be located outside of, and on opposite sides of the print zone. Alternatively, this may be in a non-split configuration. For example, the caps for the different cartridges may be located outside of, and on the same side of, the print zone. Thus, in certain embodiments of the invention, more than one servicing function may be located in a split configuration. However, in certain embodiments of the invention, not all servicing functions need be located in a split configuration.

In the present embodiment, if the controller determines that either of the cartridges has run out of ink or has failed for some other reason, the controller is programmed to continue printing with the one remaining good cartridge, in a printing mode known as "reserve mode". Thus, in the event that the black cartridge 30 fails, the printer is able to continue printing in colour, or black and white, using only the tri-colour cartridge 32. In this case, cyan, magenta and yellow inks are mixed where required to generate a composite black colour to replace the black ink of the black cartridge 30. In the event that the tri-colour cartridge 32 fails, the printer is able to continue printing in a monochrome grey scale using only the black cartridge 30. This may be the case even if one, two or three of the individual colours of the tri-colour cartridge fail. The reserve mode printing function may be implemented in any suitable known manner. The functionality of the reserve mode may be controlled by hardware, firmware, or software associated with the controller of the printer. Reserve mode printing modes are well understood in the art of inkjet printing and therefore will not be described further.

Figure 2:
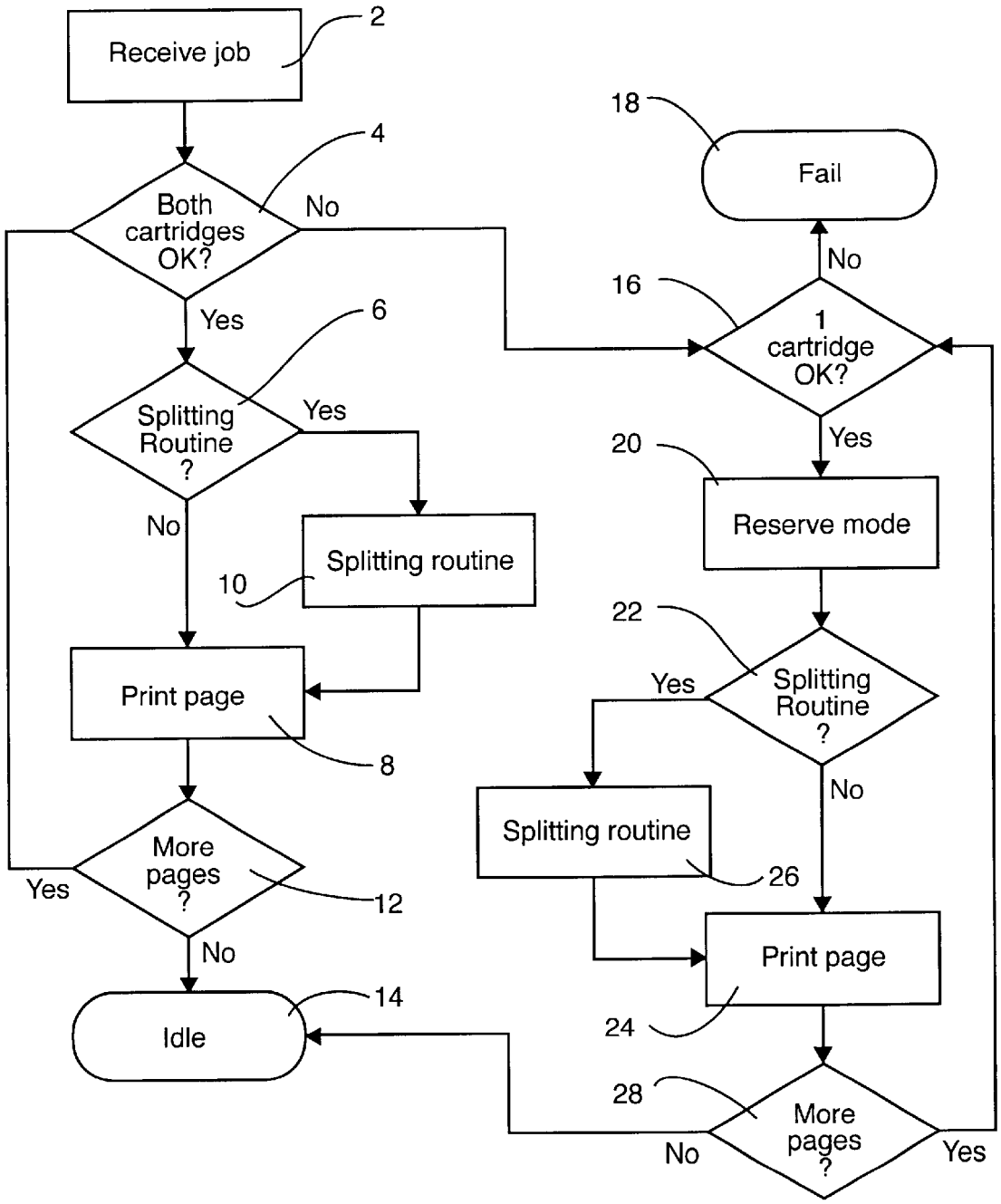

Referring to FIG. 2, the method of the present embodiment will now be described.

At step 2 of the method, the printer receives a print job in a conventional manner. At step 4, the controller determines whether or not both of the cartridges 30 and 32 are functioning correctly, or whether at least one of them has failed. In the present embodiment, the controller establishes whether or not each of the cartridges has failed by sending a conventional health interrogation signal to a chip located on the cartridge, via the normal communication path. If the cartridge replies, it is assumed that the cartridge is functioning correctly and has not run out of ink. A lack of a reply indicates that the cartridge has failed. However, as the skilled reader will appreciate, many methods of establishing the health of an inkjet cartridge or printhead are known in the art. For example, conventional drop detection techniques may be implemented to determine the health of individual nozzles of cartridge and hence establish the health of a pen. However, any suitable method of determining the health of a cartridge or printhead may instead be used.

If the controller determines that neither of the cartridges has failed, the printing mode of the printer remains in its default printing mode; i.e. printing with both cartridges. The controller then determines in a conventional manner at step 6 whether a spitting routine is due. In the present embodiment the controller periodically determines that the two cartridges are required to undergo a spitting routine. This may be when the printer is switched on, after a predetermined period of time has elapsed since the previous spitting routine was carried out, after the printer has printed a given number of pages, or after a period derived from a combination of these factors. The skilled reader will understand that many methods exist for determining when spitting operations should be implemented in order to balance the requirements of printhead health and throughput. Any suitable such method may be used in combination with the present invention.

If it is determined that a spitting routine is due, this is carried out at step 10. Since the printer is in the normal printing mode it implements a normal spitting routine. Thus, in the present embodiment, the carriage is moved first to one end of the scan axis in order that a first of the cartridges may implement a spitting routine by spitting into its corresponding spittoon. Subsequently, the carriage is moved to the opposite end of the scan axis in order that the second of the cartridges may implement a spitting routine by spitting into the other spittoon.

The method then proceeds to step 8 where a page of the print job is printed in a normal manner. In the event that it is determined at step 6 that no spitting routine was due, the method proceeds directly to step 8. After the page has been printed, the controller determines whether any further pages remain to be printed, at step 12. If no pages remain to be printed, the printer enters an idle state at step 14. Otherwise, the method continues at step 4. The steps 4 to 12 are then repeated until all of the pages of the print job are determined to have been printed at step 12 and the printer enters the idle state at step 14, or until at least one cartridge 30, 32 is determined to have failed at step 4. In this case, the method progresses to step 16.

At step 16, the controller determines whether at least one of the cartridges 30 is still functioning. If neither of the cartridges 30 and 32 is deemed to be functioning, the printer enters a fail state at step 18 and outputs a corresponding message to the user. If, however, the controller determines that at least one of the cartridges 30 and 32 has not failed, the controller enters the reserve mode appropriate to the one still functioning cartridge, at step 20.

At step 22, the controller determines whether a spitting routine is due. In the present embodiment, this is carried out in the same manner as employed at step 6. However, in other embodiments of the invention, the controller may use different criteria to determine whether a spitting routine has fallen due in reserve mode printing. In this way, spitting routines may be implemented in a manner which better match the different workload that a single working cartridge experiences in reserve mode printing, compared to the normal printing mode. For example, if it may be desirable to service the working cartridge more often. It may even be desirable to employ different spitting routines, with more or less aggressive spitting cycles for example, when working in the reserve mode compared to the normal printing mode.

If it is determined that a spitting routine is required, this is carried out at step 26. Since the printer is printing in reserve mode it only implements a spitting routine for the single cartridge or pen that was identified at step 16 as still functioning. Thus, in the case that the cartridge 30 is identified as still functioning and the cartridge 32 as having failed, the carriage is moved such that the cartridge 30 is positioned over the spittoon 34 and a spitting routine is implemented for the cartridge 30. If, on the other hand, it is the cartridge 32 that is identified as still functioning and the cartridge 30 as having failed, the carriage is moved such that the cartridge 32 is positioned over the spittoon 36 and a spitting routine is implemented for the cartridge 32. The operation of servicing routines during the reserve mode may be controlled by hardware, or software. However, more usually, this is implemented in firmware associated with the controller of the printer. In the present embodiment, in neither case is a spitting routine attempted for the cartridge that is deemed to have failed, nor is the failed cartridge moved to its spittoon in the reserve mode. In this manner, a spitting routine in the reserve mode may be significantly quicker in the present embodiment than in prior art methods. This is because in the present embodiment, the time normally spent attempting to implement a spitting routine with the failed cartridge is saved. Additionally, the time normally spent moving the failed cartridge to its corresponding spittoon, such that a spitting routine may be implemented, is also saved.

Once the spitting routine is complete, a page is printed in reserve mode at step 24. If on the other hand it is determined at step 22 that no spitting routine was due, the method proceeds directly to step 24. After the page has been printed, the controller determines whether any further pages remain to be printed, at step 28. If no pages remain to be printed, the printer enters an idle state at step 14. Otherwise, the method continues at step 16. The steps 16 to 28 are then repeated until all of the pages of the print job are determined to have been printed at step 28 and the printer enters the idle state at step 14, or until both cartridges are determined to have failed at step 16 and the printer enters a fail state at step 18.

It will thus be apparent to the skilled reader that the method of the present embodiment allows servicing routines to be implemented in a significantly more time efficient manner than is the case with prior art split servicing printers. Thus, the throughput of printing devices according to the present embodiment may be substantially increased relative to prior art split servicing printers.

The present invention may yield the greatest advantages in printing situations where frequent and time consuming servicing tasks are implemented, or where significant aerosol would be generated if a failed pen were to implement spitting routines. However, the skilled reader will appreciate that the present invention may be applied with benefit even in systems and situations where this is not the case.

Further Embodiments

In the above embodiment numerous specific details are set forth in order to provide a thorough understanding of the present invention. It will be apparent however, to one skilled in the art, that the present invention may be practiced without limitation to these specific details. In other instances, well known methods and structures have not been described in detail so as not to unnecessarily obscure the present invention.

Although the above-described embodiment was described with reference to a printer device with a reduced footprint, suitable for use in an office environment, the skilled reader will appreciate that the present invention may be applied to any printer with a split service station arrangement; for example, portable printers. Furthermore, the invention may also be applied to other hardcopy devices that incorporate a printing engine and split servicing arrangement. Example of such devices may include copiers and fax machines and all in-one-devices, sometimes known as multi-function printers, and the like.

In the method of the above-described embodiment, reserve mode spitting routines were described as being implemented between the printing of consecutive pages of a print job. However, the skilled reader will realise that in other embodiments of the invention, reserve mode spitting routines may be carried out in between printing different portions of the same page; i.e. whilst that page remains in the print zone of the printer. Furthermore, although in the above described embodiment, the servicing routine described was a spitting routine, the skilled reader will realise that the invention may be applied to other types of servicing routine, or combinations of servicing routines. For example, the invention may be applied to spitting routines alone, wiping routines alone, or other types of servicing routine for example diagnostic health checks or capping. Alternatively, the invention may be applied to any combination of these servicing routines. For example, spitting and wiping.

Additionally, although in the above-described embodiment, the printer has two pens or cartridges, a greater number of pens may be used in other embodiments of the invention; for example, three, four or six pens. In an embodiment of the invention having three pens the split servicing configuration may be implemented by having two of the pens being serviced at a first side of the print zone and the remaining pen being serviced at the opposite side of the print zone. In an embodiment of the invention having four pens (e.g. arranged to print cyan, magenta, yellow and black inks) the split servicing configuration may be implemented by having two of the pens being serviced at a first side of the print zone and the two remaining pens being serviced at the opposite side of the print zone. In such an embodiment, pens being serviced at the same side of the print zone may normally be serviced in parallel. Where two or more pens are serviced at the same side of the print zone, if one of them fails, it need not be serviced. However, it may be necessary to move the printer carriage to the side of the print zone corresponding to the service station of the failed pen in order to service a further pen which is serviced at the same side of the print zone.

Furthermore, although in the above-described embodiment the printer has a black pen and a three-colour pen, pens with different coloured inks and/or different types of ink may instead be used. Such combinations may include: a black pen and a photo-printer pen; or, a three-colour pens and a photo-printer pen.

As the skilled reader will be aware, in some print modes of some printers it is desirable to avoid printing with a given pen even though that pen has not failed. An example of this is printing in certain glossy modes or photo print modes in certain printers, where the printer has dye based colour inks and a pigment based black ink. In such cases the printer is sometimes configured to print in certain glossy modes or photo print modes using only the colour inks; i.e. not printing with the black pen. In this manner an undesirable interaction between the dye based inks and the pigmented ink may be avoided. In such cases, it may be desirable to avoid servicing the pen which is not used, even though it has not failed. Thus, the skilled reader will understand that the present invention may also be applied to such situations. In this situation, the use of a reserve mode may be triggered by the selection of print mode made by the user as opposed to the detection a pen failure.

What is claimed is:

1. An inkjet printing device comprising a print zone and first and second printheads mounted to a carriage arranged to traverse said print zone, said device further comprising first and second service stations arranged to service said first and second printheads respectively, said service stations being located such that said carriage has first and second servicing positions to allow the servicing of said first and second printheads respectively, said device being arranged to print in a first print mode in which said first printhead is not used and being further arranged not to service said first printhead whilst printing in said first print mode.

2. A device according to claim 1, wherein said carriage is arranged to traverse said print zone along a scan axis, said first and second service stations being disposed outside of said print zone, said first and second service stations being respectively substantially adjacent to first and second ends of said scan axis.

3. A device according to claim 1, wherein said first and second service stations respectively comprise first and second spittoons, said first spittoon being arranged to receive ink from said first printhead and said second spittoon being arranged to receive ink from said second printhead.

4. A device according to claim 3, wherein said first and second service stations respectively comprise first and second wiper elements, said first wiper element being arranged to wipe said first printhead and said second wiper element being arranged to wipe said second printhead.

5. A device according to claim 3, wherein said first and second service stations respectively comprise first and second cap elements, said first cap element being arranged to cap said first printhead and said second cap element being arranged to cap said second printhead.

6. A device according to claim 3, wherein said first and second service stations respectively comprise first and second further servicing elements, said first further servicing element being arranged to service said first printhead and said second further servicing element being arranged to service said second printhead.

7. A device according to claim 3, further comprising one or more further service stations arranged to service said first and second printheads, said one or more further service stations being located such that said carriage has a further servicing position allowing the simultaneous servicing of said first and second printheads by one or more further service stations.

8. A device according to claim 7, wherein said one or more further service stations are located in said print zone.

9. A device according to claim 7, wherein said one or more further service stations are located outside of said print zone.

10. A device according to claim 7, wherein said one or more further service stations comprise one or more wiping or capping elements arranged to wipe or cap said pens.

11. A device according to claim 3, wherein said device is arranged to detect the failure of said first printhead and to print in said first print mode in response to said detection.

12. A device according to claim 3, wherein said device is arranged to detect an out of ink status of said first printhead and to print in said first print mode in response to said detection.

13. A device according to claim 3, wherein said device is arranged to print in said first print mode in response to a selection made by a user.

14. A device according to claim 3, wherein said device comprises a printhead arranged to print in black ink and a printhead arranged to print in three ink colours, or a printhead arranged to print in black ink and a photo-colour printhead, or a printhead arranged to print in three ink colours and a photo-colour printhead.

15. A device according to claim 14, wherein said device is a portable printer.

16. A device according to claim 14, wherein said device is a thermal inkjet printer.

17. An inkjet printing device comprising first and second pens and first and second service stations, said first and second service stations being arranged in a split servicing configuration and being arranged to service said first and second pens respectively, said device being adapted to detect the failure of a said pen and to print in a reserve mode in response to said detection, said device being further adapted to implement a modified servicing routine during reserve mode printing, said modified servicing routine being adapted to omit servicing of the failed pen.

18. An inkjet printer comprising a print zone and a scan axis traversing said print zone, said printer further comprising a carriage arranged to travel along said scan axis and first and second printheads mounted to said carriage, said printer further comprising first and second service stations arranged to service said first and second printheads respectively, said service stations being disposed outside of said print zone and respectively being substantially adjacent to first and second ends of said scan axis such that said carriage has first and second servicing positions to allow the servicing of said first and second printheads respectively, said printer being arranged to detect the failure of said first printhead and arranged to print in a reserve print mode not using said failed first printhead in dependence upon said detection, the device being further arranged not to service said first printhead whilst printing in said reserve print mode.

19. A method of printing with an inkjet device, said device comprising first and second printheads mounted to a carriage and arranged to traverse a print zone, said device further comprising first and second service stations arranged to service said first and second printheads respectively, said service stations being located such that said carriage has first and second servicing positions to allow the servicing of said first and second printheads respectively, the method comprising the steps of:

printing in a print mode not using said first printhead;

implementing one or more printhead servicing routines, said routines omitting to service said first printhead.

20. A method according to claim 19, wherein said step of implementing one or more printhead servicing routines comprise the step of implementing a spitting, capping or wiping routine for a printhead being serviced, said step of implementing a spitting, capping or wiping routine being omitted for said first printhead.

21. A method according to claim 20, wherein said step of implementing one or more printhead servicing routines comprises the step of transporting said carriage to a servicing position corresponding to a printhead being serviced prior to implementing said step of implementing said spitting, capping or wiping routine for a printhead being serviced, said step of transporting said carriage to a servicing position corresponding to said first printhead being omitted.

22. A computer program comprising program code for performing the method steps of claim 19 when said program is run on a processing device associated with suitable printer device.

* * * * *